United States Patent [19]

Young et al.

[11] Patent Number: 4,469,200

[45] Date of Patent: Sep. 4, 1984

[54] RELEASABLE HOISTWAY DOOR SAFETY INTERLOCK

[75] Inventors: Robert W. Young, Avon; Harry J. Friedenreich, Southington, both of Conn.

[73] Assignee: Otis Elevator Company, Farmington, Conn.

[21] Appl. No.: 316,364

[22] Filed: Oct. 29, 1981

Related U.S. Application Data

[63] Continuation of Ser. No. 125,737, Feb. 28, 1980, abandoned.

[51] Int. Cl.[3] ..... B66B 13/00

[52] U.S. Cl. ..... 187/61; 49/141; 70/465

[58] Field of Search ..... 187/61, 57, 56, 51, 187/46; 49/141, 73, 118; 70/465

[56] References Cited

U.S. PATENT DOCUMENTS 885,924 4/1908 Hollinger ..... 187/61

1,838,524 12/1931 Brown ..... 187/61

*Primary Examiner*—Joseph J. Rolla

*Assistant Examiner*—Kenneth Noland

*Attorney, Agent, or Firm*—Robert E. Greenstien

[57] ABSTRACT

To prevent passengers in an elevator from opening the hoistway door when the car is well above the floor, a rotatable arm is located below the car and engages the hall door to prevent it from being opened. This arm may be reached from the floor, by opening the hoistway doors slightly, and rotated to disengage it from the door, which may then be fully opened.

9 Claims, 1 Drawing Figure

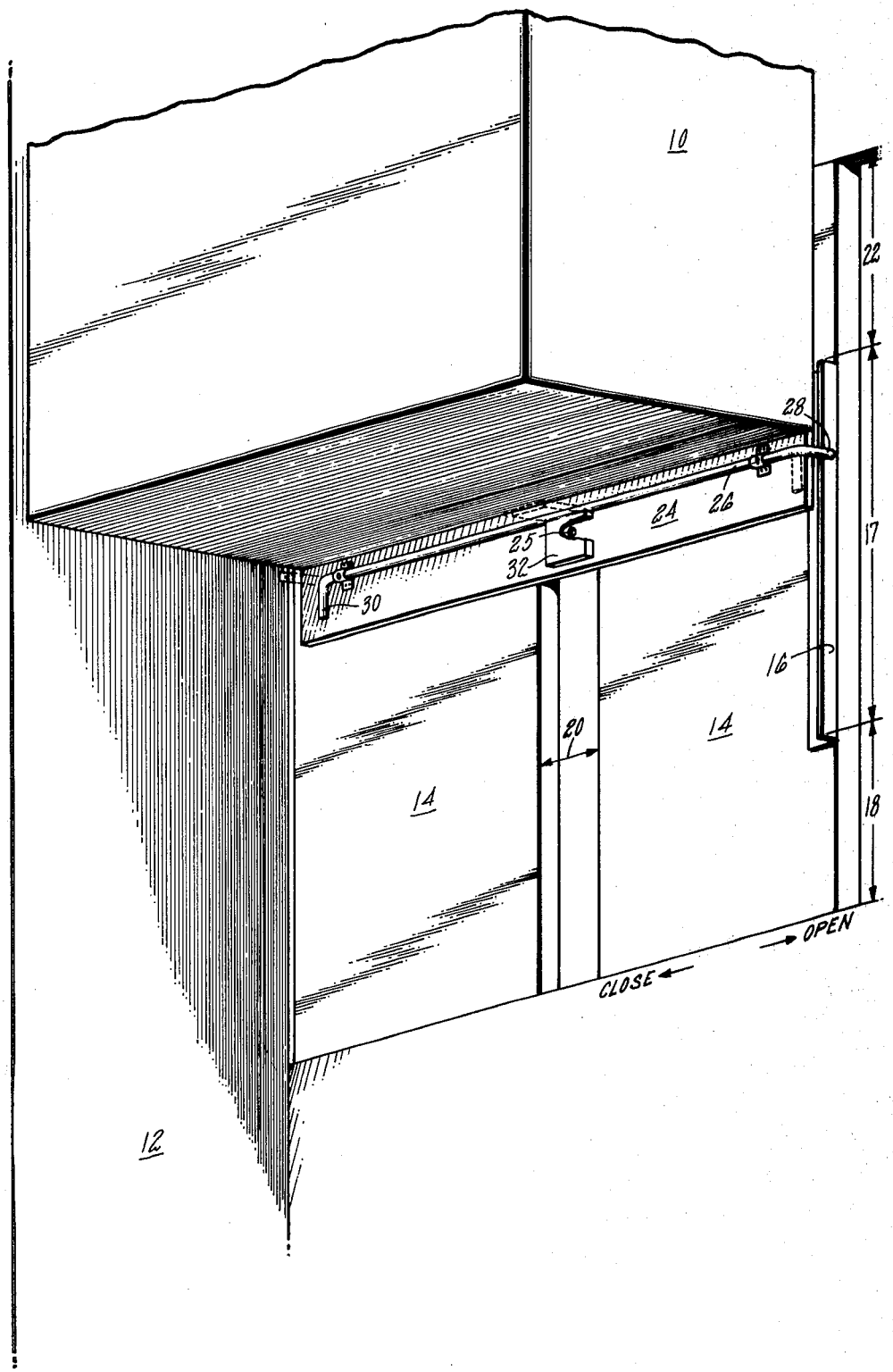
10
22
28
24
26
25
32
30
17
16
20
14
14
18
OPEN
CLOSE
12

RELEASABLE HOISTWAY DOOR SAFETY INTERLOCK

This is a continuation of application Ser. No. 125,737 filed on Feb. 28, 1980, now abandoned.

TECHNICAL FIELD

This invention relates to elevator systems; specifically, releasable interlock apparatus for restricting manual opening of the hoistway doors from an elevator car when the elevator car is between floors.

BACKGROUND ART

To facilitate evacuation of an elevator car, many elevator systems are deliberately designed so that the car doors can be manually pulled open. With the car doors open, however, the hoistway door latch or interlock (which prevents occupants on the floor from opening the hoistway doors when the car is not safely close to the floor) may be released by the passengers, who can then pull the hoistway doors open. But, if the car is substantially above the floor level when this is done, there is a rather large space, between the bottom of the car and the floor, leading to the shaft or hoistway. Passengers attempting to leave a car which is at that particular position may, inadvertently, step or slip through that space in attempting to reach the floor.

It is not surprising, then, that there is a need for a safety arrangement which, if the car is in an "unsafe zone" (too far above the floor for passengers to reach the floor), prevents passengers from opening the car doors and pulling the hoistway doors back far enough to enable them to exit the car yet allows the doors to be opened, at any car position, from the floor; in other words, a system that allows the passengers to leave only if the car is in a "safe zone" (close to the floor). Obviously, an arrangement meeting these requirements should also allow the passengers to open the car doors enough to communicate with people on the floor and to receive emergency equipment.

U.S. patent application Ser. No. 120,443, by Gibson et al, filed on Feb. 11, 1980, titled BETWEEN LANDING CAR DOOR SAFETY LOCK, now abandoned and also assigned to the owner of this application, shows a system which meets most of these requirements. In that system the car and hoistway doors engage each other in such a way that the hoistway doors, which are closed by the safety interlock, stop the car doors from opening. But, because of that, the car doors cannot be opened without simultaneously opening the hoistway doors. U.S. Pat. No. 1,838,524 shows an arrangement which couples the car and hall door and prevents the car door from opening between landings, but it does not permit limited opening of the car door at certain car positions.

DISCLOSURE OF THE INVENTION

A better system, as provided by the instant invention, should permit the car doors to be opened all the way by the passengers, and, for passenger safety, should only restrict the hall door opening to an acceptable distance for communication and transfer of equipment. The rationale for this is obvious: As long as passengers cannot reach the floor, because of the nearly fully closed hall doors, the potentially dangerous path to the hoistway is effectively blocked, and it is far easier, and more reliable, if the car and hoistway doors can be opened independently.

In accordance with the present invention, a hoistway door engages a stop member which is located below the elevator car; at a point which cannot be reached by the passengers, yet which is not on the car doors, thus allowing the passengers to open the car doors completely. In effect, the hoistway door engages the car. This engagement takes place if the car is within the unsafe zone, which begins at a predetermined distance above the floor. When the car is between floors the stop member can be reached from the floor if the hoistway doors are opened slightly. This member is movable to another position at which it disengages or releases the hoistway door, which then can be opened fully.

In one specific application of the invention this stop member may comprise a rod which is pivotally mounted behind the toe guard, which is frequently found below the car entrance sill on most elevator systems to block off the space that is created between the bottom of the car and the hoistway, when the car is above the floor. In this application the toe guard is provided with an access port to provide access to the rod which is rotated or moved to disengage it from the door. The access port may be keyed to limit access to authorized personnel, and the rod may be biased or weighted so that it normally is in a position for engaging the hoistway door when the door is opened to a certain minimum "rescue" opening distance, to release the door, the rod is rotated from that position.

Among the features of this invention is that it provides an interlock apparatus which is ideally suited for retrofit installations in existing elevator systems, particularly those having a toe guard which conveniently provides an additional barrier to prevent passengers in the car from reaching the apparatus and that it may have as few as one moving part—the rod.

BRIEF DESCRIPTION OF DRAWING

The drawing is a perspective view of a portion of a hoistway; here a car, partially shown, is in the unsafe zone, between two floors, and center opening hoistway doors on one floor are opened to the rescue distance.

BEST MODE FOR CARRYING OUT THE INVENTION

Referring to the drawing, an elevator car 10 is in the unsafe zone between floors in a hoistway 12. Located on one floor which is shown are two elevator doors 14 which are coupled together so that as one opens the other one opens synchronously to provide a "center opening" hoistway door arrangement. These center opening doors are shown for exemplary purposes to illustrate the operation of the present invention; single or multiple door section telescoping or side opening door arrangements may also be used.

Located along the edge (furthest from the opening) of one of the doors 14 is an L bracket or bar 16. This bar has a length 17 and is attached at a distance 18 above the floor. The distance 17 defines the unsafe zone (the zone at which the hall doors 14 should not be allowed to be opened by the passengers beyond a predetermined maximum rescue distance 20). This unsafe zone begins at the distance 18 and ends at the distance 22 from the top of the doorway. When the car is at or less than the distance 22, the space available for passengers to enter and leave the car is too small to present a danger; similarly, when the car is less than the distance 18 above the floor, the distance is also acceptable.

Located below the bottom of the car 10 is a toe guard 24, comprising a plate which is as wide as the hoistway door opening. Pivotally mounted on the toe guard is a rod 26; this rod contains an arm-like extension 28 which extends towards the doors 14. At the opposite end of the rod there is another arm 30 which is in quadrature (90°—right angle) with the arm 28; and located at the center of the rod is a plate 32. The plate 32 and the arm 30 bias the rod to an "at rest position" at which the arm 28 extends towards the doors 14, as shown. The toe guard 24 contains a hole 25 that provides access to the plate 32 from the space when the doors are slightly open. A tool, possibly just a screwdriver, may be inserted into the hole to engage the plate 32 and apply force to rotate the rod 24 to a position at which the arm 26 is no longer substantially extending towards the doors 14 (as shown by the dotted lines in the drawing).

The arm 28 engages the bracket 16 to prevent the hoistway doors 14 (which as mentioned above are coupled together) from opening beyond the distance 20. However, by rotating the rod the arm and the bracket 16 disengage, thus releasing the doors 14 from the car; the doors may then be fully opened manually.

Although the toe guard is shown to have a hole which is generally circular to allow for the use of a tool as basic as a screwdriver to rotate the rod 26, this hole may be keyed (such as the "lunar key" arrangement, often used for the hoistway door interlock) to provide a measure of security so that the rod 26 can be rotated only by a similarly keyed device. For example, passengers in the car can open the car doors (not shown) all the way, since the car doors are not engaged with the hoistway doors. And with the hoistway doors 14 only opened to the rescue distance 20, passengers may attempt to reach down and rotate the rod 26. Thus, the use of a keyed hole is particularly advantageous where that is a possibility. However, operation by the passengers without a screwdriver or the like may be made extremely difficult by properly weighting the plate 32 and arm 30: to require substantial force to be applied to the plate 32 to rotate the rod 26 to a position at which the arm 28 clears the L bracket 16.

The extent of the distance 20 is determined by the door movement distance until the arm 28 and the bracket 16 engage. In most elevator systems the car is wider than the door opening and the toe guard is usually about the same width. Thus the distance 20 may be determined simply by the extension of the rod 26 beyond the toe guard if the bracket 16 is merely attached to the "jam" side of the door as shown in the drawing. Obviously, the bracket 16 can be moved towards the opening to increase the distance 20; but it is considered preferred to locate it along the jam side (as shown) in order to keep it away from any equipment on the outside of the car doors.

In a side opening installation it is likewise preferred for the bracket 16 to be located on the jam side; that is, the side away from the opening. In a side opening installation the access hole in the toe guard and the plate 32 are located not in the middle of the car, but rather near the edge where the door opens. In that case the arm 30 may be interchanged with the plate 32, although it is not necessary to have the arm 30 if the plate 32 is appropriately sized and weighted to provide the biasing that is suggested previously to cause the rod 26 to be in a normal position for engaging the bracket 16.

Other modifications and variations in and to this embodiment of the invention will be obvious to one skilled in the art without departing from the true scope and spirit of the invention.

We claim:

1. An elevator system comprising a car with a car door and, on each floor, a hoistway door, characterized by a hoistway door interlock apparatus that limits the extent to which the hoistway door opens when the car is at a position more than a certain first distance above the floor level, and that the hoistway door interlock may be operated from the floor to permit the hoistway door to open completely without operating the car door or moving the car from said position;

a first member that is attached to the car and that is stationary thereon relative to the direction in which the hoistway door opens and closes and that is also stationary relative to the motion of the car door; and a second member that is attached to the hoistway door and that engages said first member as the hoistway door opens, the engagement between the two acting to restrict further opening of the hoistway door which is connected through the engagement to the car;

the second member extending in the direction the car moves for a second distance from said position, and occupying space between the hoistway door and the car; and the first member being a third distance from the second member as measured in the direction the hoistway door opens, and operable from the floor to be moved out of the path of the second member.

2. An elevator system according to claim 1, comprising a toe guard, and characterized in that the first member is located behind the toe guard and is accessed for operation through the toe guard.

3. An elevator system comprising a car with a car door, on each floor a hoistway door, and a toe guard on the car, characterized by a hoistway door interlock apparatus that limits the extent to which the hoistway door opens when the car is at a position more than a certain first distance above the floor level, and that the hoistway door interlock may be operated from the floor to permit the hoistway door to open completely without operating the car door or moving the car from said position, comprising:

a first member that is attached to the car behind the toe guard and that is stationary thereon relative to the direction in which the hoistway door opens and closes and that is also stationary relative to the motion of the car door; and a second member that is attached to the hoistway door and that engages said first member as the hoistway door opens, the engagement between the two acting to restrict further opening of the hoistway door which is connected through the engagement to the car;

the second member extending in the direction the car moves for a second distance from said position, and occupying space between the hoistway door and the car; and the first member being a third distance from the second member as measured in the direction the hoistway door opens; operable through the toe guard from the floor to be moved out of the path of the second member.

4. In an elevator system comprising a car with a car door and on each floor a hoistway door, hoistway door interlock apparatus that limits the extent to which the hoistway door opens when the car is at a position more than a certain first distance above the floor level, and that the hoistway door interlock may be operated from the floor to permit the hoistway door to open completely without operating the car door or moving the car from said position, characterized by:

a first member that is attached to the car and that is stationary thereon relative to the direction in which the hoistway door opens and closes and that is also stationary relative to the motion of the car door; and a second member that is attached to the hoistway door and that engages said first member as the hoistway door opens, the engagement between the two acting to restrict further opening of the hoistway door which is connected through the engagement to the car;

the second member extending in the direction the car moves for a second distance from said position, and occupying space between the hoistway door and the car; and the first member being a third distance from the second member as measured in the direction the hoistway door opens, and operable from the floor to be moved out of the path of the second member.

5. The invention of claim 4, characterized in that the first member is located behind a toe guard on the car and is accessible, for operation, through the toe guard.

6. An elevator system having a car which is moved in a hoistway between floors and, on each floor, a hoistway door arrangement which includes at least one door which is movable between open and closed positions and a toe guard below the car, characterized by:

a hoistway door interlock apparatus for preventing the opening of the hoistway door beyond a prescribed rescue distance when the car is within a prescribed unsafe zone above the floor level, said apparatus including a first member carried on the car, said member engaging a second member on the hoistway door on each floor when the door is beyond said rescue distance and the hoistway door interock being operable from each floor through a minimum door open position less than or equal to said rescue distance to be disengaged from the hoistway door;

said second member being vertically attached to the hoistway door beginning at a certain point above the floor level for engaging said first member when the hoistway door is at said rescue distance, the vertical extent of said second member defining said unsafe zone, and said first member being operable, with the door at a slightly open position, to be disengaged from said second member to permit full opening of the door;

said first member being concealed behind the toe guard; and said toe guard including an access port providing access to said first member.

7. An elevator system according to claim 6, characterized in that, said access port is keyed to limit access to said first member so that said first member can be operated only with a similarly keyed device that is extended through the toe guard.

8. An elevator system according to claim 6 or 7, characterized in that:

said first member comprises a rod which is rotatably fixed to the toe guard, said rod contains an arm-like portion extending, from behind the toe guard, to the hoistway door;

said second member comprises an elevated bar which is attached to the door edge and, beginning at a prescribed distance above the floor level, extends therealong for a predetermined distance defining said unsafe zone; and said arm engages said bar, and when said rod is rotated, is disengage from said bar;

said rod is constructed so that, when not rotated, said arm is in a bar engaging position.

9. An elevator system according to claim 8, characterized in that said rod contains a weighted portion which biases the rod to said bar engaging position.

* * * * *